United States Patent [19]

Holan

[11] Patent Number: 4,819,299

[45] Date of Patent: Apr. 11, 1989

[54] SELF-CLOSING HINGE

[76] Inventor: Leif A. Holan, P.O. Box 3527, Clear Lake Highlands, Calif. 95422

[21] Appl. No.: 138,142

[22] Filed: Dec. 28, 1987

[51] Int. Cl.[4] ..... E05F 1/12

[52] U.S. Cl. ..... 16/278; 16/296; 16/303; 16/333; 16/347; 16/74

[58] Field of Search ..... 16/74, 278, 284, 293, 16/296, 325, 303, 333, 347

[56] References Cited

U.S. PATENT DOCUMENTS

| | | | |
|---|---|---|---|
| 470,334 | 3/1892 | Karo . | |
| 588,642 | 8/1897 | Hoffman . | |
| 2,702,651 | 2/1955 | Grahm | 16/293 |
| 3,205,532 | 9/1965 | MacDonald | 16/278 |
| 3,262,149 | 7/1966 | Gorton et al. | 16/296 |
| 3,391,420 | 7/1968 | Anderson | 16/291 |
| 3,550,187 | 12/1970 | Swartz | 16/278 |
| 3,722,030 | 3/1973 | Smith | 16/303 |
| 3,728,757 | 4/1973 | Lloyd | 16/303 |
| 3,822,440 | 7/1974 | Stansbury, Jr. et al. | 16/303 |
| 3,837,043 | 9/1974 | Coe | 16/303 |
| 3,842,463 | 10/1974 | Wehner | 16/142 |
| 4,177,540 | 12/1979 | Gorton | 16/142 |
| 4,193,165 | 3/1980 | Malacheski | 16/191 |
| 4,287,641 | 9/1981 | MacDonald | 16/139 |
| 4,654,930 | 4/1987 | Lautenschlager, Jr. et al. | 16/296 |

OTHER PUBLICATIONS

Anonymous two pages of photo print of hardware.

*Primary Examiner*—Nicholas P. Godici
*Assistant Examiner*—Edward A. Brown
*Attorney, Agent, or Firm*—Frederick E. Mueller

[57] ABSTRACT

A self-closing hinge comprising a pair of hinge leaves pivotally interconnected by an offset hinge pin. A spring tang is formed integrally with one of the hinge members and has a distal end that has a head projecting substantially radially with respect to a sleeve of the other hinge leaf within which the hinge pin is mounted. The external surface of the sleeve serves as a cam surface against which a follower element carried on the head of the spring tang is biased. The line of force exerted by the head of the tang through the follower is distally offset relative to the axis of the hinge pin. During closing of the hinge the follower is brought into registration with a pocket formed in the sleeve effecting a rocking movement of the follower about one edge of the pocket to generate a self-closing moment.

14 Claims, 3 Drawing Sheets

SELF-CLOSING HINGE

BACKGROUND OF THE INVENTION

The present invention relates to hinges and, more particularly, to a self-closing hinge.

SUMMARY OF THE INVENTION

In its preferred embodiment, the hinge of the invention comprises a fixed leaf and a swingable leaf, pivotally interconnected by an offset hinge pin, with one or the other of the leaf members incorporating an integrally formed spring tang whose distal end rockably or pivotably mounts a cam follower that coacts with a cam surface of the other leaf. More particularly, the fixed leaf has a planar base portion formed with a flange along one edge that includes a central tab that is rolled to define the cam surface and to partially confine a central portion of the hinge pin. The flange may also include opposite end ear portions which may be curled and folded to define keepers to prevent axial displacement of the hinge pin out of the assembled hinge. The planar base portion of the fixed leaf is preferably formed with a central clearance or relief space adapted to register with a base portion of the swingable leaf when the hinge is closed. The fixed leaf may also have other integral portions formed in a configuration adapted for seating on the frame of the opening in which the hinge is to be mounted.

The swingable leaf has a planar base portion that along one edge is formed with a spaced apart integral pair of flanges having tabs that are rolled into hinge pin knuckle formations. The swingable leaf in a central portion of the base is integrally formed with a spring tang whose distal end is formed with a flange or head that is offset relative to the common plane of the adjacent pair of flanges. The arrangement is such that the line of force of the head of the tang is distally offset relative to the axis of the hinge pin when the parts are assembled. The head of the tang is seated within a pocket or cavity of the cam follower by an abutment means whose shape characteristics accommodate rocking action of the follower relative to its seat on the tang head. The abutment means may take the form, for example, of a concave seat defined within the follower pocket on which an edge of the tang head is seated, the edge having a radius similar to that of the concave seat of the follower. Alternatively, the edge of the head of the tang may be flat and have line contact with an arcuately shaped ridge defining the seat of the follower.

The follower is preferably made of a hard, essentially incompressible synthetic plastic material, such as Delrin acetal resin, selected for a relatively low coefficient of friction with respect to the cam surface with which it reacts. The follower is formed with reinforcing opposite end walls that confine the opposite ends of the head of the tang. A cam engaging concave face is defined along the side of the follower opposite to its pocket and has a radius like that of the cam surface against which it is biased by the spring tang.

DESCRIPTION OF DRAWINGS

FIG. 5 is a top plan view of a pair of the hinges of the invention schematically shown as supporting an adjacent pair of cabinet doors over a framed opening of a cabinet or the like.

DESCRIPTION OF THE PREFERRED EMBODIMENTS

Figure 1:
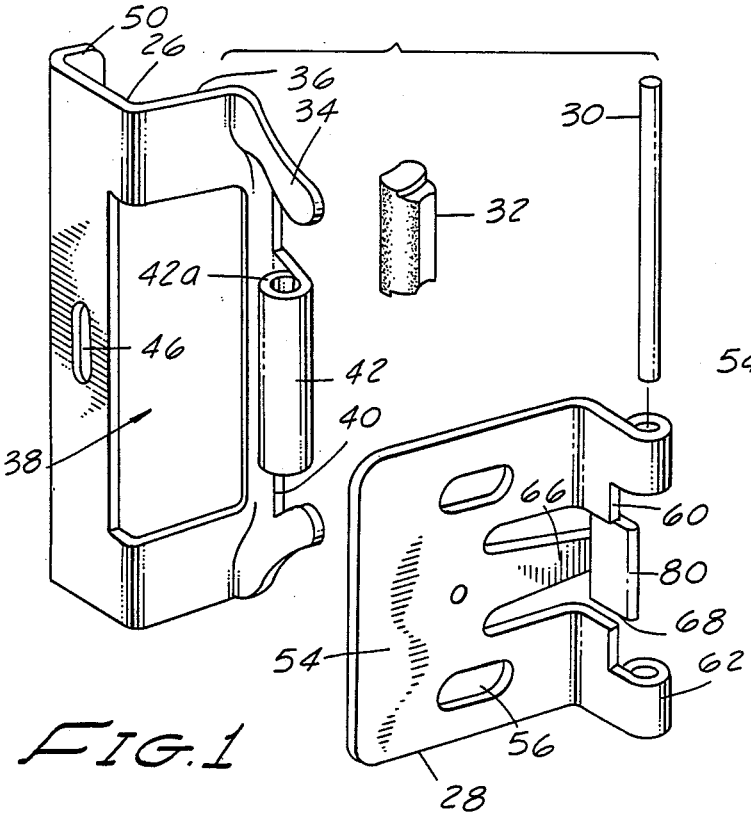
FIG. 1 is an exploded perspective view of the four components of the preferred embodiment of the invention.

Before explaining the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purposes of description and should not be regarded as limiting.

Figure 5:
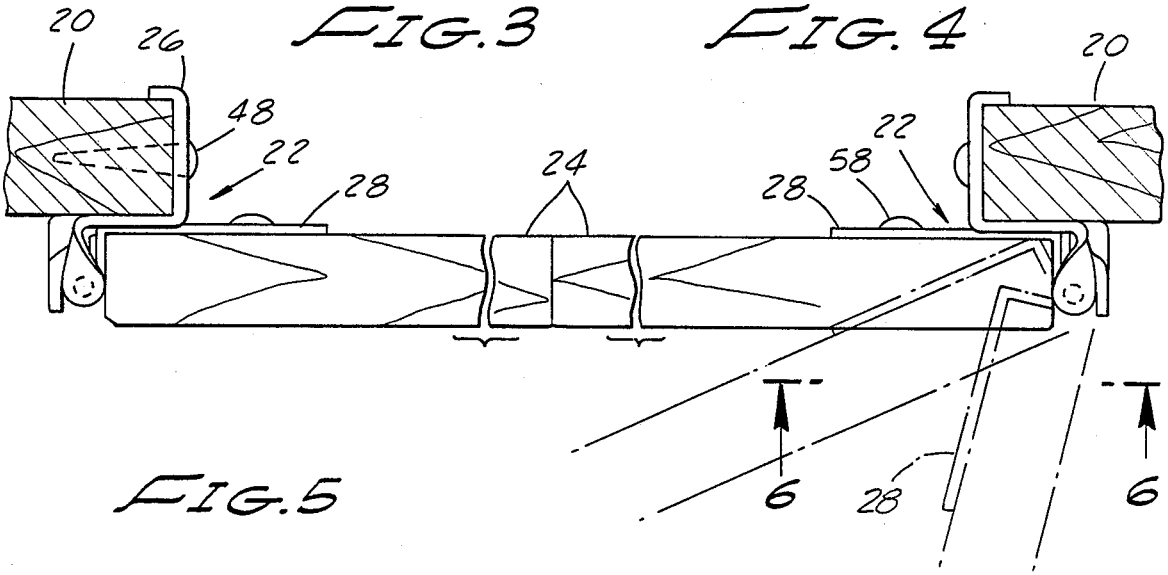

FIG. 5 schematically depicts an opening in a cabinet or the like, opposite vertical edges of which are framed by members 20. The hinge assembly of the invention is indicated by the reference numeral 22 and it will be understood that at least a pair of the hinge assembles 22 are fitted to each of the frame members 20 to support one of a pair of doors 24, which can be individually opened and closed relative to the opening of the cabinet.

Figure 2:
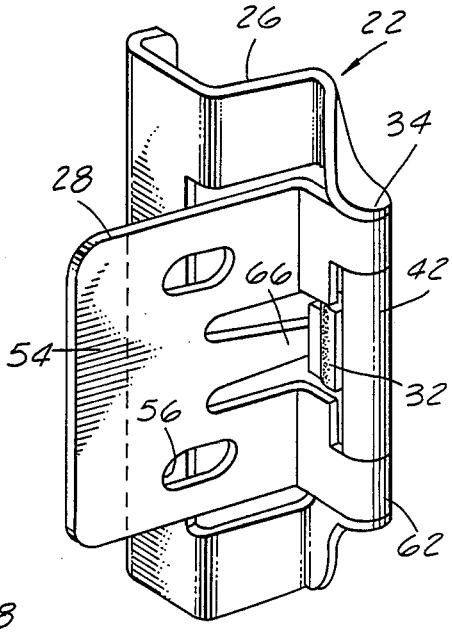
FIG. 2 is a perspective view of the assembled components of the invention.

Referring to FIGS. 1 and 2, an assembly 22 comprises a fixed leaf 26, a swingable leaf 28, a hinge pin 30 and a follower 32. In the illustrated embodiment, the parts 26, 28 may be economically produced by blanking and forming the parts out of a steel sheet material, while the hinge pin 30 may merely comprise an appropriate length of steel rod of appropriate diameter. Also, the follower 32 is of a configuration which lends itself to mass production out of an appropriate hard synthetic plastic material or a powdered metal.

Figure 6:
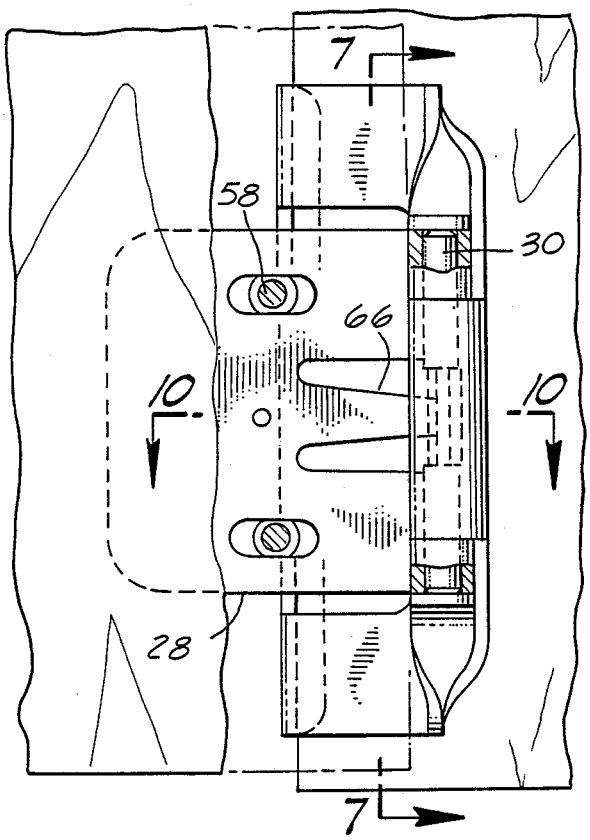
FIG. 6 is an elevational view taken on the line 6—6 of FIG. 5, portions being broken away to illustrate inner details of construction.

More specifically, the fixed leaf 26 comprises a planar base portion 36 adapted to seat on a face of the cabinet opening frame. In the illustrated case, an essentially rectangular portion of the base 36 is pierced out of the sheet material to define an opening 38 to ensure a clearance space for the action of the swingable leaf 28, which may be required in some cases. Along the hinge pin side of the leaf 26 the sheet material is formed into an upstanding flange 40 extending over the length of the piece. A median portion of the flange 40 includes an integral outwardly projecting tab having a terminal edge of shallow U-shaped configuration which is rolled over into a nearly cylindrical configuration to define a partial sleeve 42 flanked by fully rolled sleeves **42*a*** of an inner diameter adapted to rotatably mount the hinge pin 30. The opposite ends of the flange 40 have symmetrical outwardly projecting ears 34 which can be bent and folded into the attractive finished configuration illustrated in FIGS. 2 and 6, wherein the pair of ears neatly confine the hinge pin 30 against axial displacement out of the assembly.

As will e apparent, the base 36 could be secured to the cabinet frame opening merely by means of appropriate fasteners penetrating the material of the base. However, in the illustrated embodiment the fixed hinge 26 along its side opposite to the flange 40 is formed into a generally channel shaped configuration comprising a face plate 44 having a vertically elongate slot 46 formed therethrough for the reception of an appropriate fastener 48, such as shown in FIG. 5. A short flange 50 may be provided along the edge of face plate 44 in parallel opposition to base portion 36 to abut the inside of the cabinet frame member.

The swingable leaf 28 comprises a base portion 54 of a width slightly less than the corresponding dimension of the cutout 38 in the fixed leaf 26. Along a pair of opposite edges the base 54 is formed with an elongate parallel pair of fastener openings 56 to receive appropriate fasteners 58 for securing the leaf to the corresponding door, as illustrated in FIG. 5. Along its hinge side the swingable leaf 28 includes an upstanding spaced apart symmetrical pair of upright co-planar flanges 60 each of which develops into outwardly projecting tab portions which can be rolled into completed essentially cylindrical form to define a coaxial pair of knuckles or sleeves 62 adapted to rotatably seat opposite end portions of the hinge pin 30.

In its mid-portion, along an axis normal to the hinge axis, the base 54 of the swingable leaf is integrally formed, as by notches in the base, with a tang 66 whose distal end is formed into an integral upstanding flange or head 68. Preferably, the tang 66 is of the tapered configuration shown with its opposite edges tapering convergently from the proximal to the distal end of the tang. The head or flange 68 of the tang preferably takes the substantially rectangular form shown with a dimension transversely of the tang which is larger than the width of the distal end of the tang. The swingable leaf 28 is made of a spring steel material or, alternatively, after fabrication the part is tempered in its entirety, or the tang 66 is tempered, in order to induce or create a spring action for the tang 66. In any event, the desired result is that the tang 66 be inherently resilient such that it resists deflection away from the base 54 and at all times biases the tang head 68 and the follower 32 carried thereby in the direction of the hinge pin 30, and against the cam surface of the sleeve 42.

Figure 3:
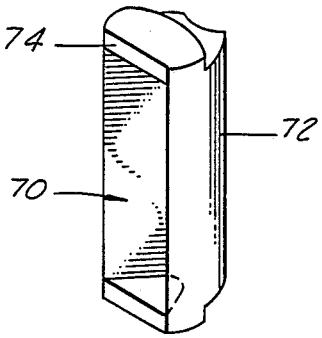
FIG. 3 is a perspective view of the cam follower component of the invention, rotated 90 degrees about its long axis with respect to its representation in FIG. 1.

Referring to FIG. 3, the follower 32 is formed along one side with a pocket or cavity 70 that is defined between a pair of opposite side walls 72 and a pair of opposite end walls 74. The length of the pocket 70 is such that the similar length of the head 68 of the tang 66 is receivable therein with a sliding or slight clearance fit relative to the inside faces of the end walls 74. The overall length of the follower 32 between the outside faces of the end walls 74 is such that the follower is moveable with a slight clearance relative to the confronting edges of the gap defined between the pair of fully rolled sleeves 42*a* of the fixed leaf 26.

Figure 4:
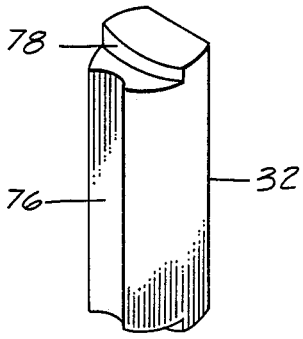
FIG. 4 is a perspective view of the component of FIG. 3 but rotated 180 degrees on its long axis.
Figure 7:
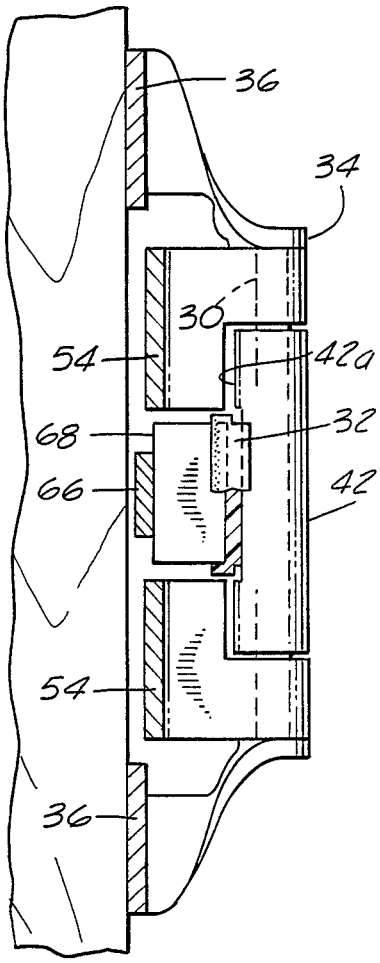
FIG. 7 is a sectional view taken on the line 7—7 of FIG. 6.

Referring to FIG. 4, a face 76 of the follower 32 which is opposite to the pocket 70 is formed in the shape of an arcuate depression having a radius complementary to the radius of the outer or cam surface of the sleeve 42 of the fixed leaf 26. The concave face 76 is of a length substantially the same as that of the pocket 70 in the tang head 68 so that the spring force of the tang is distributed uniformly along the length and throughout the area of the bearing contact between the concave surface 76 and the outer face of the sleeve 42 of the fixed leaf 26. As the follower 32 undergoes a kind of rocking action in the assembly a relief is provided at its opposite ends to clear adjoining parts of the structure, in the form of a shoulder defined by an arcuate edge 78 of the corresponding end wall 74, as illustrated in FIG. 7.

Figure 8:
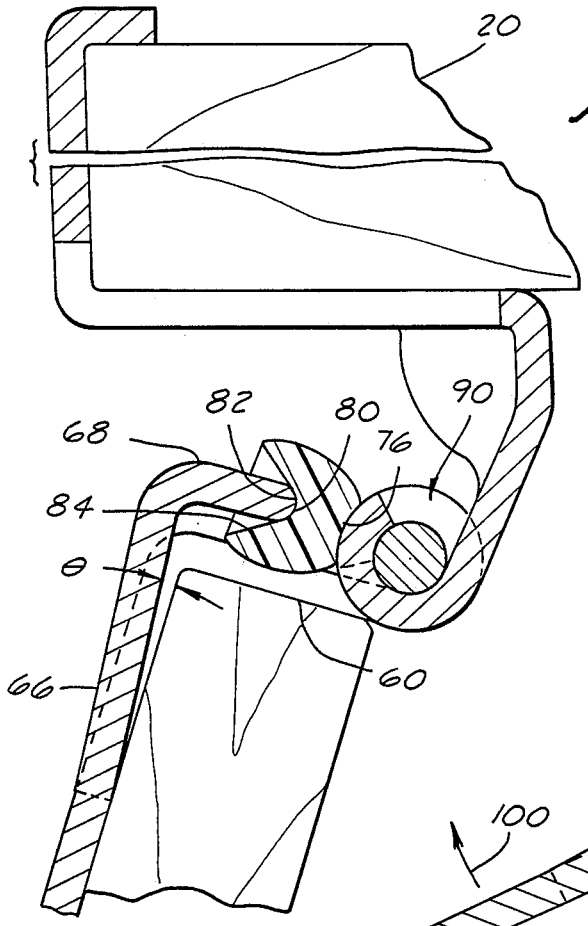
FIGS. 8, 9, and 10 are schematic sectional views taken on the 10—10 of FIG. 6 but showing the two leafs of the hinge in different relative positions.
Figure 9:
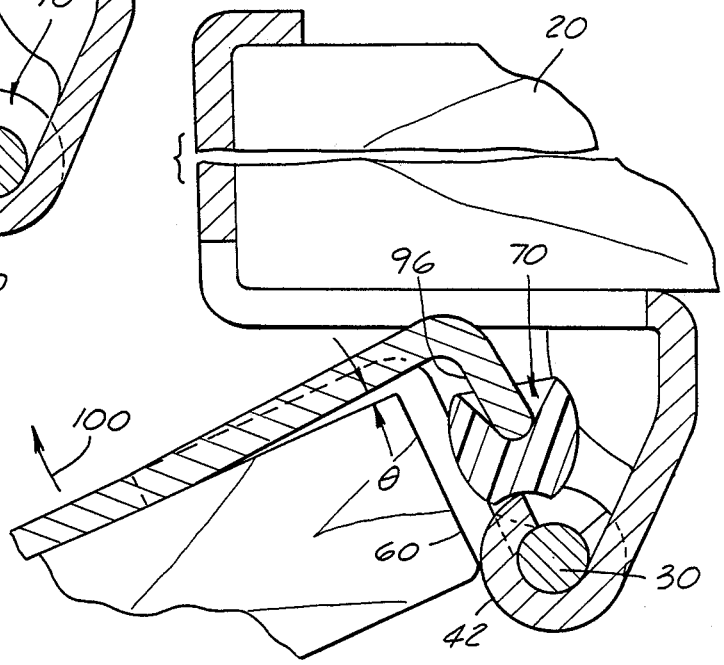
Figure 10:
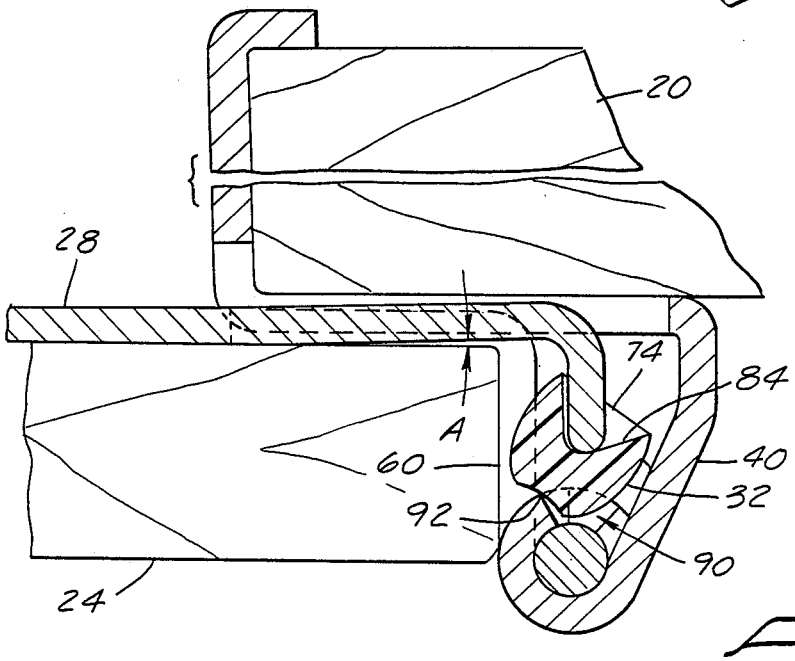

The terminal edge 80 of the tang head 68 is formed into a semi-cylindrical surface having a diameter of the thickness of the material of the head 68. Similarly, as seen in FIGS. 8 through 10, the bottom of the pocket 70 of the follower 32 is formed with a concave seat 82 of a radius complementary to that of the edge 80, while the opposite internal sides 84 of the pocket flare divergently outwardly towards the mouth of the pocket 70. Clearance is thus provided within the pocket 70 for rocking movement of the follower 32 relative to the tang head 68.

As indicated in FIG. 10, the cam surface 42 extends through less than 360 degrees, e.g., through about 270 degrees, to define an internal pocket 90 into which one edge of the follower 32 can be tilted when the hinge is in the fully closed condition. At the same time, a terminal edge 92 of the outer surface of the cam 42 which defines one side of the pocket 90 is engaged with a longitudinal trace of the seat 76 while the follower 32 is held under compression between the edge 92 of the cam surface and the rounded edge 80 of the tang head 68.

In this connection, it will be observed that the parts are so proportioned that when the hinge is in the closed condition of FIG. 10 the tang 66 occupies a pre-stressed condition deflected out of the plane of the body 54 of the swingable leaf 28 through an angle A. Preferably, during manufacture of the part the tang 66 is bent slightly out of the plane of the body 54 in the opposite direction from that indicated in FIG. 10 and the whole part or the tang portion is then tempered. Thus, when the tang 66 is in a condition of least deflection in the assembly 22, as indicated in FIG. 10, it has already been preloaded to exert a substantial spring force in the direction of the hinge pin 30.

The swingable leaf 28 is formed such that the tang head 68 occupies a plane distally offset relative to the common plane of the pair of flanges 60 such that the thrust axis of the tang head 68 is distally offset relative to the axis of the hinge pin 30. More specifically, using the proximal face 96 of the tang head 68 as a convenient reference, when the hinge is in the closed FIG. 10 condition the proximal face 96 is approximately coplanar with the axis of the hinge pin 30, so that the thrust axis of the tang head 68 is distally related relative to the same axis. In the FIGS. 8 and 9 conditions the tang 66 has been displaced through an angle theta $\theta$ greater than the angle A of FIG. 10, so that the proximal face 96 of the tang head 68 has been angularly displaced distally beyond the FIG. 10 condition. Accordingly, the thrust axis of the tang head 68 is offset distally relative to the FIG. 10 condition and exerts a stronger moment relative to the axis of the hinge pin 30.

FIG. 8 shows a door 24 held in a desired open adjusted position by a hinge 22 of the invention. In this condition, the follower 32 is symmetrically aligned with the tang head 68 and the concave face 76 of the follower is fully engaged with the cam surface 42. Although the follower 32 is preferably made of a material having a low coefficient of sliding friction relative to the surface 42 the coefficient of static friction of the follower is increased by the spring action of the tang 66 deflected through the angle $\theta$, thus insuring that the door holds its desired adjusted position.

The self-closing action of the hinge 22 is illustrated in FIGS. 9 and 10. As the door 22 is moved from the position of FIG. 8 towards the FIG. 9 condition the follower 32 is advanced in a clockwise direction, as viewed in the drawing, to a point where the leading edge of the follower face 76 passes beyond the edge 92 of the pocket 90 in the sleeve portion 42. Approximately when the thrust axis of the tang head 68 moves in a clockwise direction beyond the edge 92 the follower 32 rolls on the tang edge 80 and undergoes a pivot action or rocking movement about the edge 92. A self-closing moment 100 is thus produced in the door 22. The closing moment continues as door 24 arrives at and seats itself in the fully closed position indicated in FIG. 10, in which condition the follower 32 is arrested in an asymmetrically disposed condition relative to the tang head 68, which may be limited by mutual abutment between an inner face 84 of the follower pocket and the proximal side 96 of the tang head.

Figure 11:
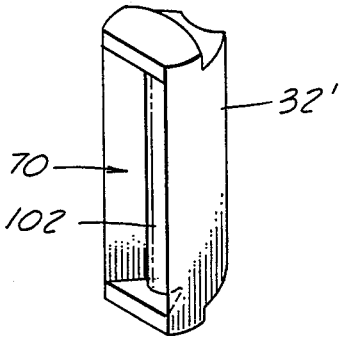
FIG. 11 is a perspective view of an alternative embodiment of the cam follower component.
Figure 12:
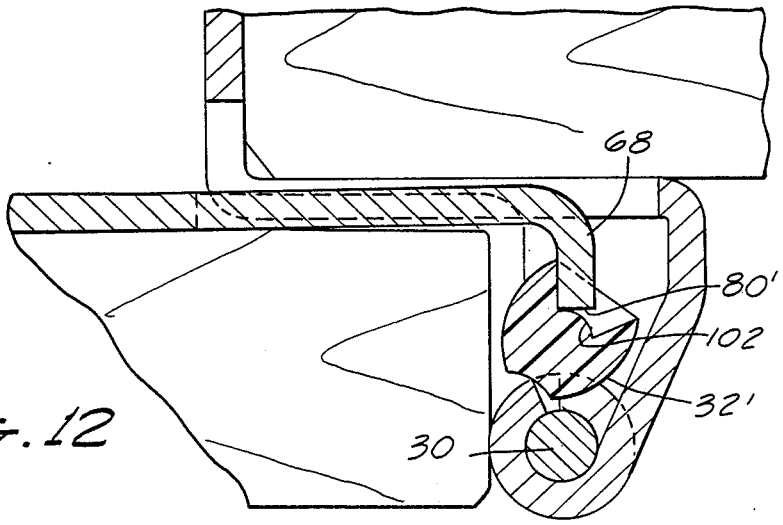
FIG. 12 is a view like FIG. 10 illustrating an alternative embodiment of the invention.

The alternative embodiment of invention shown in FIGS. 11 and 12 is essentially the same as that of FIGS. 1–10 except for the means of engagement between the end of the tang head 68 and the follower 32. In this case, the tang head 68 is formed with an edge 80' that is flat rather than semi-cylindrical as in the case of the first embodiment. The follower 32' is essentially the same as the follower 32 of the first embodiment except that the bottom of the pocket 70 comprises an upstanding longitudinal extending ridge 102 of arcuate cross section rather than the concave seat 82 of the first embodiment. The mode of operation of the alternative embodiment is substantially the same as that of the first embodiment.

It will be apparent that the hinge leaves are not limited to fabrication out of metallic materials, e.g., steel, aluminum or phosphor bronze, and that for some applications the parts may be made of an appropriate synthetic plastic material. So, too, the follower 32 is not limited to the synthetic plastic of the preferred embodiment but may comprise any essentially incompressible material that is compatible with the other parts of the hinge, e.g., a porous bronze bearing a lubricant such as Oilite. These and various other changes and modifications may be made in accordance with the present invention.

I claim:

1. A hinge assembly comprising:

a first leaf and a second leaf having sleeves in coaxial alignment with one another;

a hinge pin coaxially journaled within said sleeves for pivotally interconnecting said first leaf and said second leaf for angular movement relative to one another;

said first leaf having an integral spring means having a head portion projecting substantially radially with respect to said hinge pin and with respect to said sleeve of said second leaf;

said sleeve of said second leaf being formed with a pocket that is aligned and in registration with said head portion of said spring means when said second leaf is in a closed position relative to said first leaf; and a hard substantially incompressible follower means mounted between said head portion of said spring means and said sleeve of said second leaf in a manner to be co-moveable with said first leaf relative to said second leaf;

said spring means biasing said follower means in the direction of said hinge pin and into contact with an external surface of said sleeve of said second leaf along a thrust axis that is distally offset relative to the axis of said hinge pin;

contacting parts of said head portion of said spring means, said follower, and one edge of said pocket of said sleeve of said second leaf having shape characteristics such that when said leaves are in a relatively open condition said follower is restrained against rocking movement relative to said head portion of said spring means and such that when said head portion of said spring means and said follower are rotated past said edge of said pocket said follower undergoes rocking movement relative to said head portion of said spring means and relative to said edge of said pocket.

2. A hinge assembly as in claim 1 in which said first leaf is adapted to act as the swingable leaf of said assembly.

3. A hinge assembly as in claim 1 in which:

one of said leaves has a spaced pair of integrally formed ear portions positioned at and closing the opposite ends of said coaxially aligned sleeves to prevent axial displacement of said hinge pin out of said hinge assembly.

4. A hinge assembly as in claim 1 in which:

each of said leaves comprises a base portion having an integral flange and said sleeves comprise integral portions.

5. A hinge assembly as in claim 1 in which:

said integral spring means comprises a tang portion of said first leaf oriented normally relative to said hinge pin and said head portion of said spring means is positioned at a distal end of said tang.

6. A hinge assembly as in claim 5 in which:

said follower means is formed along one side with a cavity within which a terminal edge of said head portion of said tang is received, said cavity being internally formed with divergent opposite side walls to accommodate said rocking movement of said follower relative to said head portion of said spring means.

7. A hinge assembly as in claim 6 in which:

opposite ends of said follower and of said head portion of said tang have cooperating means to prevent displacement of said follower from said head portion in a direction parallel to said terminal edge of said head portion.

8. A hinge assembly as in claim 7 in which:

said cooperating means comprises end walls formed integrally with said follower that close the opposite ends of said cavity of said follower means.

9. A hinge assembly as in claim 6 in which said external surface of said sleeve of said second leaf is formed with a substantially uniform radius.

10. A hinge assembly as in claim 6 in which:

said contacting parts of said head portion of said spring means and said follower comprise said terminal edge of said head portion of said tang and a seat defining a floor of said cavity of said follower means.

11. A hinge assembly as in claim 10 in which:

said seat of said cavity of said follower means is concave and said terminal edge of said tang portion of said spring means is hemispherical, said concave seat and said terminal edge having substantially the same radius.

12. A hinge assembly as in claim 10 in which:

said terminal edge of said head of said tang is flat and said seat of said cavity of said follower means comprises an arcuately shaped ridge, said flat edge of said head of said tang and said ridge having substantially line contact with one another.

13. A hinge assembly as in claim 11 or claim 12 in which:

said contacting parts of said follower and said one edge of said pocket of said sleeve comprise an arcuate concave depression formed along one side of said follower means, said arcuate depression having a radius substantially like that of said external surface of said sleeve of said second leaf.

14. A hinge assembly as in claim 11 or claim 12 in which:

said one edge of said pocket of said sleeve comprises a longitudinal trace of said external surface of said sleeve of said second leaf.

* * * * *

UNITED STATES PATENT AND TRADEMARK OFFICE

CERTIFICATE OF CORRECTION

PATENT NO. : 4,819,299

DATED : April 11, 1989

INVENTOR(S) : Leif A. Holan

It is certified that error appears in the above-identified patent and that said Letters Patent is hereby corrected as shown below:

In column 3, line 7, "e" should read --be--.

In column 6, line 35, "portions." should read --portions of said sleeves.--.

Signed and Sealed this

Twenty-eighth Day of November 1989

*Attest:*

JEFFREY M. SAMUELS

*Attesting Officer*

*Acting Commissioner of Patents and Trademarks*